US005989073A

United States Patent [19]

Kahoun

[11] Patent Number: 5,989,073

[45] Date of Patent: Nov. 23, 1999

[54] PANEL FEEDTHROUGH TERMINAL BLOCK ASSEMBLY

[75] Inventor: Scott D. Kahoun, Unionville, Conn.

[73] Assignee: General DataComm, Inc., Middlebury, Conn.

[21] Appl. No.: 08/796,080

[22] Filed: Feb. 5, 1997

[51] Int. Cl.[6] ..... H01R 9/24

[52] U.S. Cl. ..... 439/709; 439/651

[58] Field of Search ..... 439/709, 712, 439/715, 722, 723, 655, 651

[56] References Cited

U.S. PATENT DOCUMENTS

| | | | |
|---|---|---|---|
| 3,241,097 | 3/1966 | Ege | 439/709 |
| 3,482,206 | 12/1969 | Jackson et al. | 439/709 |
| 4,210,379 | 7/1980 | Vachhani et al. | 439/709 |
| 4,630,882 | 12/1986 | Naylor et al. | 439/709 |
| 4,924,213 | 5/1990 | Decho et al. | 439/709 |
| 5,116,246 | 5/1992 | Perry et al. | 439/709 |
| 5,242,319 | 9/1993 | Ju | 439/752 |
| 5,704,815 | 1/1998 | Shibata et al. | 439/709 |

OTHER PUBLICATIONS

Kulka Electrical Corp. Terminal Boards Catalog 17C, Jul. 1978.

Magnum® Single Row Terminal Strips Catalog, Jun. 1986.

Buchanan® Electronic Connectors Catalog I/O 100, Sep. 1992.

Weidmüller Standard Products Catalog, 1992.

Weco Electrical and Electronic Terminal Blocks and Modules Catalog No. 195, Jan., 1995.

EBY Electro Inc. Catalog (no date indicated).

Phoenix Contact Catalog (no date indicated).

Hendry Telephone Products Brochure for Fuse Panels showing terminal blocks, Aug. 1995.

Hendry Telephone Products schematic for PCB Assembly Stud Input, Master Copy date Apr. 1993, Approved date Feb. 12, 1996.

*Primary Examiner*—Hien Vu

*Attorney, Agent, or Firm*—David P. Gordon; David S. Jacobson; Thomas A. Gallagher

[57] ABSTRACT

A power block includes an insulative block which is mounted to a panel and a plurality of connection mounts which are coupled to the insulative block. The insulative block includes a plurality of molded dividers and the connection mounts are located therebetween. Each connection mount includes at least one stud extending upward from the block and a conductor having first and second portions. The first portion of each conductor is conductively coupled to the one or more studs and the second portion extends through the block in a direction opposite the one or more studs. The second portion includes a free end provided with a connector directly couplable to a destination point. A preferred aspect of the invention is that the conductor is a copper braid partially covered in a tin plated copper sleeve. According to a first embodiment, the connector at the free end of the conductor is a sleeve extending over the free end and having a hole for directly receiving a lead from a power filter. According to a second embodiment, the second portion of the conductor is formed of solid copper and the connector is a tapered free end of the second portion of the conductor which is "pluggable" into resilient clips. According to a third embodiment, the second portion of the conductors are substantially elongate and flexible, and the connector at the free end is a sleeve having a coupling slot or hole.

12 Claims, 9 Drawing Sheets

PANEL FEEDTHROUGH TERMINAL BLOCK ASSEMBLY

BACKGROUND OF THE INVENTION

1. Field of the Invention

This invention relates broadly to electronic equipment. More particularly, this invention relates to electronic equipment terminal blocks which provide a conductive connection between external and internal destination points.

2. State of the Art

Electronic components and circuitry are often provided in large racks housing circuit boards and back planes. The components are powered by a DC power source; i.e., a battery. The DC power is filtered by power filters and then distributed to the components and circuitry.

A terminal block serves as the mounting point for conductively connecting the DC power source to the power filters, or for other connections, e.g., connections to bus bars and/or back planes. Terminal blocks must be able to handle high current situations while inducing minimal voltage drop. Typically, a terminal block is mounted on a panel on the equipment housing. The panel is provided with a plurality of holes for mounting other components and for extending wires therethrough.

Current off-the-shelf terminal blocks are generally of two types. The first type of terminal block includes an elongate insulative block having a first array of mechanical connection points on a first side of the block. A second side of the insulative block (orthogonal to the first side) is provided with a second array of mechanical or solder type connection points which are conductively coupled to the first side connection points. The terminal block is assembled between the power source and power filter by (1) panel mounting the terminal block; (2) attaching wires from the power source to the terminal block by a mechanical means; (3) cutting a series of intermediate wires to length and stripping the ends of wire; (4) attaching first ends of each of the wires to the second array of connection points; (5) feeding the second ends through holes in the panel; (6) securing power filters to the rear of the panel; and (7) wrapping the second ends of the second wires around leads on the power filters and securing by nuts. The resulting arrangement conductively couples the power source to the power filters.

A second type of terminal block includes threaded studs molded into the insulative block and extending outward from front and back sides, thereby forming front and back stud portions. The terminal block is connected to the DC power source and the power filter by: (1) passing the back studs through holes in a panel such that the back of the terminal block is flush with the panel; (2) using mounting hardware to mount the terminal block to the panel; (3) coupling the power filters to the rear of the panel; (4) coupling a first array of wires extending from the power source to the front stud portions and securing in place with nuts; (5) stripping first and second ends of an array of intermediate wires; (6) coupling the first ends of the wires to the back stud portions and securing in place with nuts; (7) coupling the second ends of the array of intermediate wires to the power filter with nuts.

In each prior art design, a series of intermediate wires are required to couple the terminal block to the power filters. This has several disadvantages. First, intermediate wires increase voltage drops. In addition, with increasing wire length of the intermediate wires, the power source to power filter connection will be subject to increased EMI. It is difficult to decrease the length of the intermediate wires, as the intermediate wires must be easily manipulable by an on-site technician and must be long enough to route between the power source and the power filter (typically at least four inches). Additional voltage drop is caused by the increased number of connections required when using intermediate wires. Furthermore, assembling the prior art designs requires a time consuming procedure necessitating a large number of manual connections.

SUMMARY OF THE INVENTION

It is therefore an object of the invention to provide a terminal block which eliminates the need for intermediate wires and thereby reduces the voltage drop and susceptibility to EMI.

It is another object of the invention to provide a terminal block which requires fewer connections and thereby reduces the voltage drop and susceptibility to EMI.

It is a further object of the invention to provide a terminal block which is easily configurable to different applications.

It is also an object of the invention to provide a terminal block which reduces the time required for on-site hook-up to a power source and power filters and which can be easily serviced.

In accord with these objects which will be discussed in detail below, the terminal block of the invention, also referred to as a power block, directly connects to the desired termination point (e.g., power filters, a bus bar, or a back plane) without the need for intermediate wiring. According to the invention, the power block includes an insulative block which is mounted to a panel and a plurality of connection mounts which are coupled to the insulative block. The insulative block includes a plurality of molded dividers and the connection mounts are located therebetween. Each connection mount includes at least one stud, preferably threaded, extending upward from the block, and a conductor having first and second portions. The first portion of each conductor is conductively coupled to the one or more studs and the second portion extends through the block in a direction opposite the one or more studs. The second portion includes a free end provided with a connection means. The terminal block is mounted to a panel and the conductors extend through openings in the insulative block and in the panel. The connection means of the conductors directly connect with a desired destination point. A preferred aspect of the invention is that the conductor is a copper braid partially covered in tin plated copper sleeve.

According to a first embodiment, the connection means at the free end of the conductor is a sleeve extending over the free end of the conductor and having a hole for directly receiving a lead from a power filter. According to a second embodiment, the second portion of the conductor is formed from solid copper and the connection means is a tapered free end of the second portion of the conductor. Resilient clips are provided on a back plane for receiving the tapered free end of the conductors. The conductors may thereby be "plugged" and "unplugged" into the clips. According to a third embodiment, the second portion of the conductors are substantially elongate and flexible, and the connection means at the free ends are sleeves having coupling slots or holes. The conductors may be secured to a back plane with threaded hardware through the coupling slots or holes.

It will be appreciated the design of the power block of the invention negates the need for intermediary wires, as the connection means of the power block can be directly coupled to the power filters or other destination points. As such, the voltage drop performance is improved and EMI immunity is increased. In addition, the braided conductors have high current capabilities, substantially improved over the intermediate wires of the prior art designs. Moreover, on-site installation and servicing is expedited with the improved design. The power block is especially beneficial for use in connecting telecommunications equipment.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
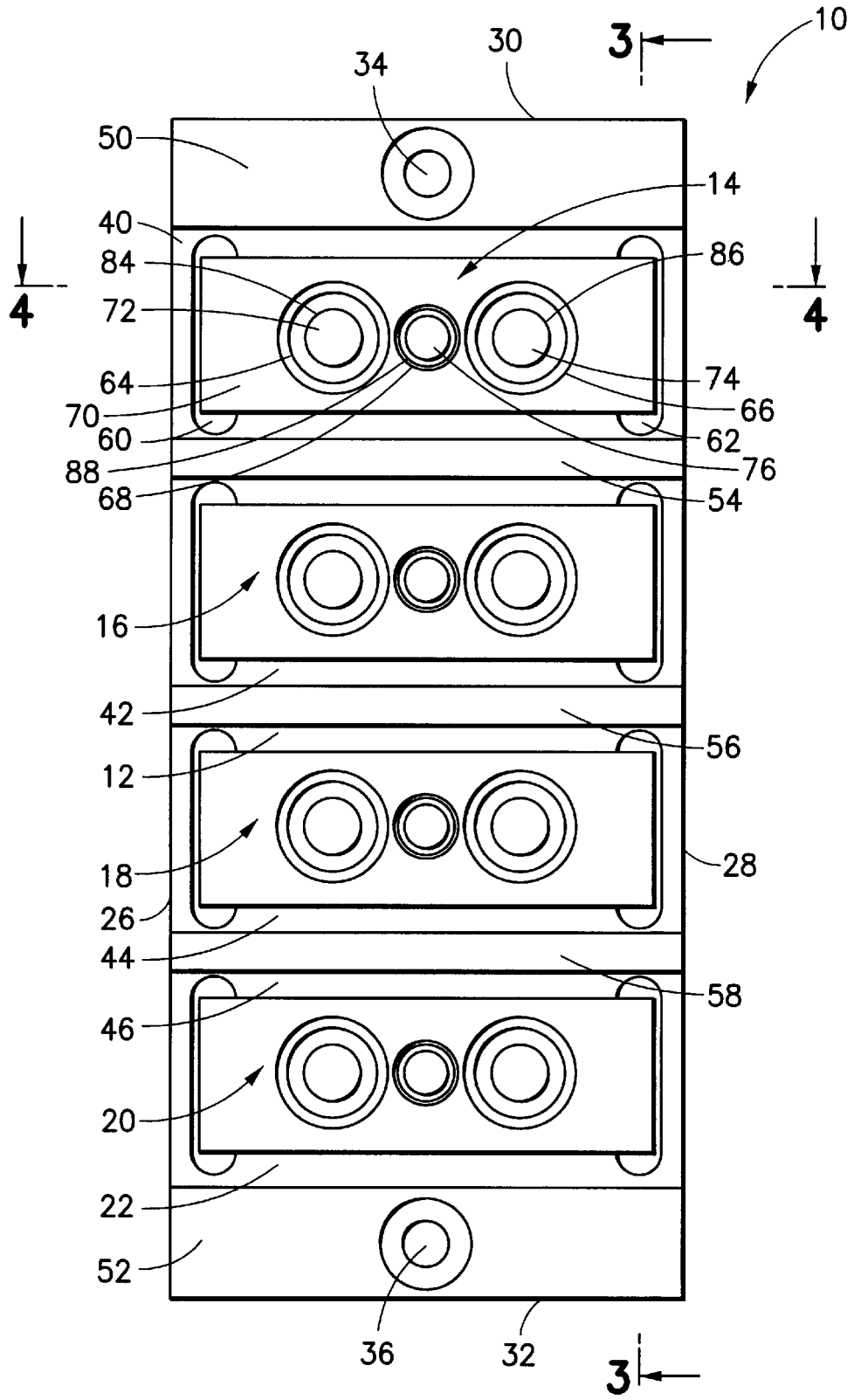
FIG. 1 is a top view of a power block according to a first embodiment of the invention.
Figure 2:
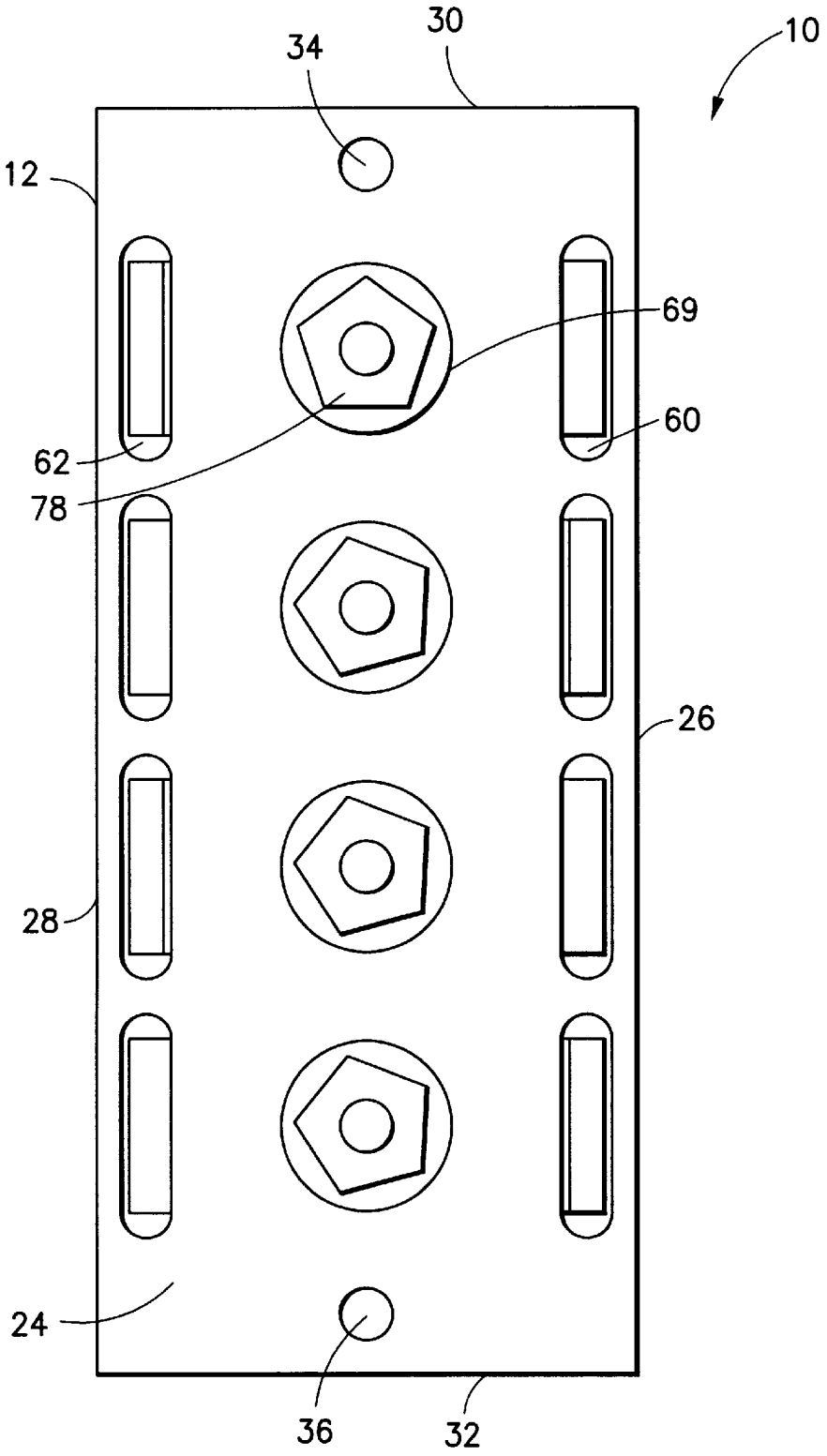
FIG. 2 is a bottom view of a power block according to a first embodiment of the invention.
Figure 3:
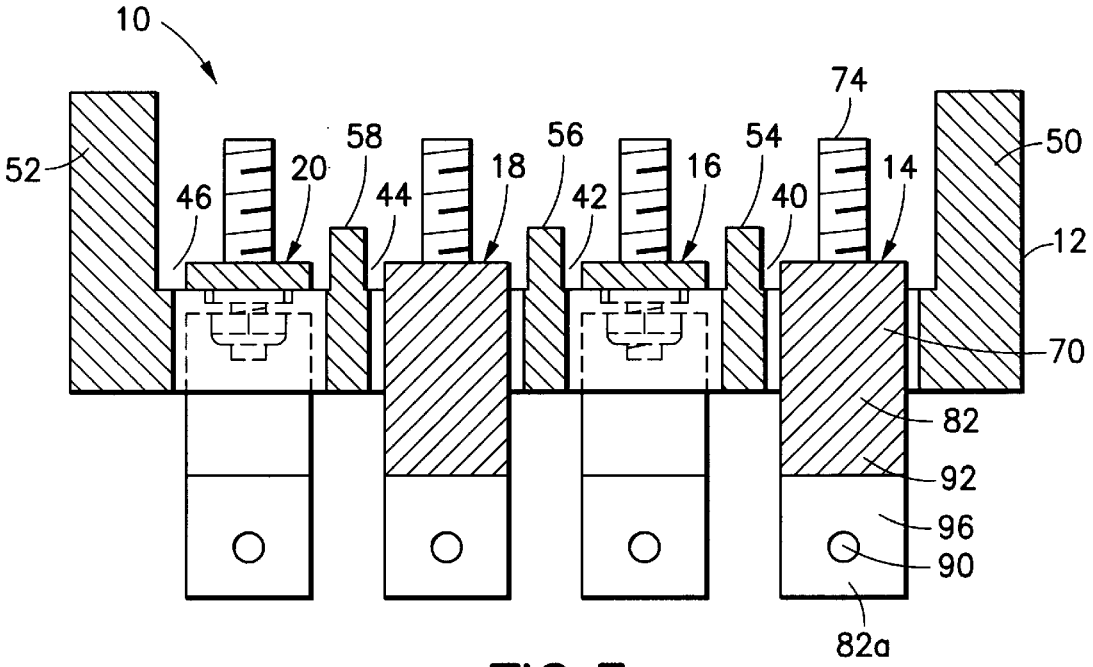
FIG. 3 is a cross section through line 3—3 in FIG. 1.
Figure 4:
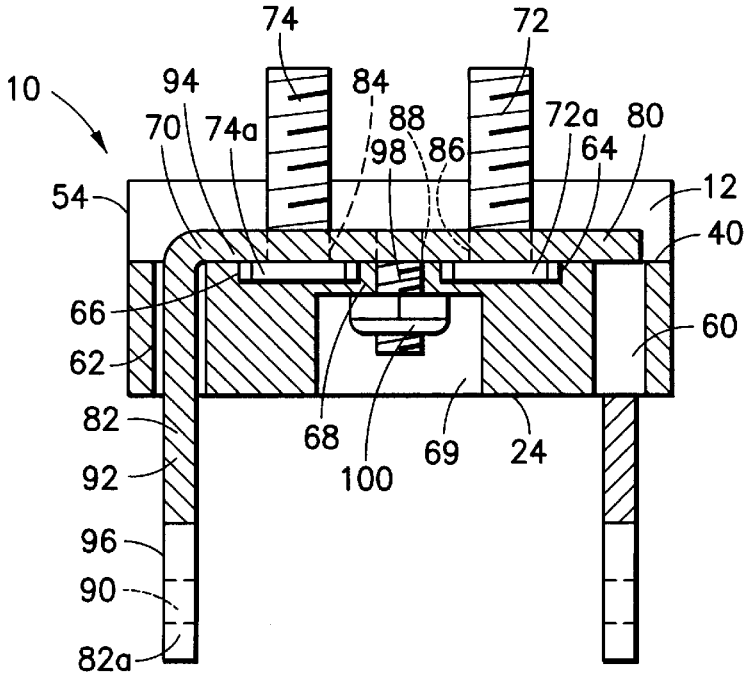
FIG. 4 is a cross section through line 4—4 in FIG. 1.

Turning now to FIGS. 1 through 4, a first embodiment of a power block 10 is shown. The power block 10 includes a molded insulative block 12 and a plurality of connection mounts 14, 16, 18, 20. The insulative block 12 has front and rear faces 22, 24 (shown in FIGS. 1 and 2, respectively), first 26, second 28, third 30, and fourth 32 sides, and mounting bores 34, 36. The mounting bores 34, 36 are countersunk on the front face 22. The block 12 preferably has raised end walls 50, 52 on the front face 22 at the third and fourth sides 30, 32 and raised dividers 54, 56, 58. Four channels 40, 42, 44, 46 are formed between the end wall and the dividers. Each channel (described with respect to channel 40 for clarity) has two lateral slots 60, 62 extending from the front face to rear face, two head depressions 64, 66 between the slots, a central bore 68 between the head depressions which extends from the front face to rear face and having at the rear face a countersink 69 coaxial with the central bore 68.

The block 12 is preferably made from polycarbonate and preferably has dimensions of approximately three and one quarter inches in length, approximately one and three quarter inches in width, and approximately one inch in height at its highest point.

The connection mounts 14, 16, 18, 20 are described with respect to one connection mount 14 for purposes of clarity. The connection mount 14 generally includes an L-shaped conductor 70, two terminal studs 72, 74, a coupling stud 76, and a nut 78. The L-shaped conductor 70 has a first portion 80 and a second portion 82 extending orthogonally from the first portion 80 and terminating in a free end 82*a*. The first portion 80 includes first and second terminal holes 84, 86 which receive threaded studs 72, 74 and a coupling hole 88 for receiving a coupling stud. The second portion 82 includes a lead hole 90 or slot at the free end 82*a* for connecting to a power filter, as discussed below with reference to FIG. 7. The conductor 70 is preferably approximately three inches in length, with the second portion 82 preferably being slightly longer than the first portion 80. The conductor 70 is preferably made of a tin copper braid 92 which is substantially flexible and preferably formed to have substantially flat sides. The first portion 80 and the free end 82*a* of the second portion (surrounding the lead hole 90) are provided with substantially inflexible conductive sleeves 94, 96, preferably made of tin plated copper. The sleeves are cold formed with the braid to form the terminal holes 84, 86 and coupling hole 88.

In a preferred two stud design and still with reference to connection mount 14, first and second terminal studs 72, 74, are preferably made of copper or a copper alloy, e.g., phosphor bronze. The first and second terminal studs 72, 74 are positioned through the first and second terminal holes 84, 86 in the first portion 80 and extend upward, i.e., opposite the extension of the second portion 82. The second portion 82 of the conductor extends into slot 62 and heads 72*a*, 74*a* of the first and second terminal studs 72, 74 are countersunk into the head depressions 64, 66, i.e., the first portion 80 of the conductor 70 lies substantially flat across the front face 22. It will therefore be appreciated that the terminal studs 72, 74 and the second portion 82 of the conductor are non-axial relative to each other; i.e. they are parallel. A coupling stud 98, preferably self-clinching, is positioned into the coupling hole 88 in the first portion 80 of the conductor 70 and extends through the central bore 68 towards the rear face 24. A nut 100 is seated into the countersink 69 and thread over the exposed end of the coupling stud 98 to secure the conductor 70 and first and second terminal studs 72, 74 to the insulative block 12. The other connecting mounts 12, 14, 16 are likewise assembled, with one exception; the connecting mounts are alternately arranged such that the second portion of each conductor extends through a slot on the side (e.g., 26) of the insulative block opposite the side (e.g., 28) through which the conductor of the adjacent connecting mount extends.

Figure 5:
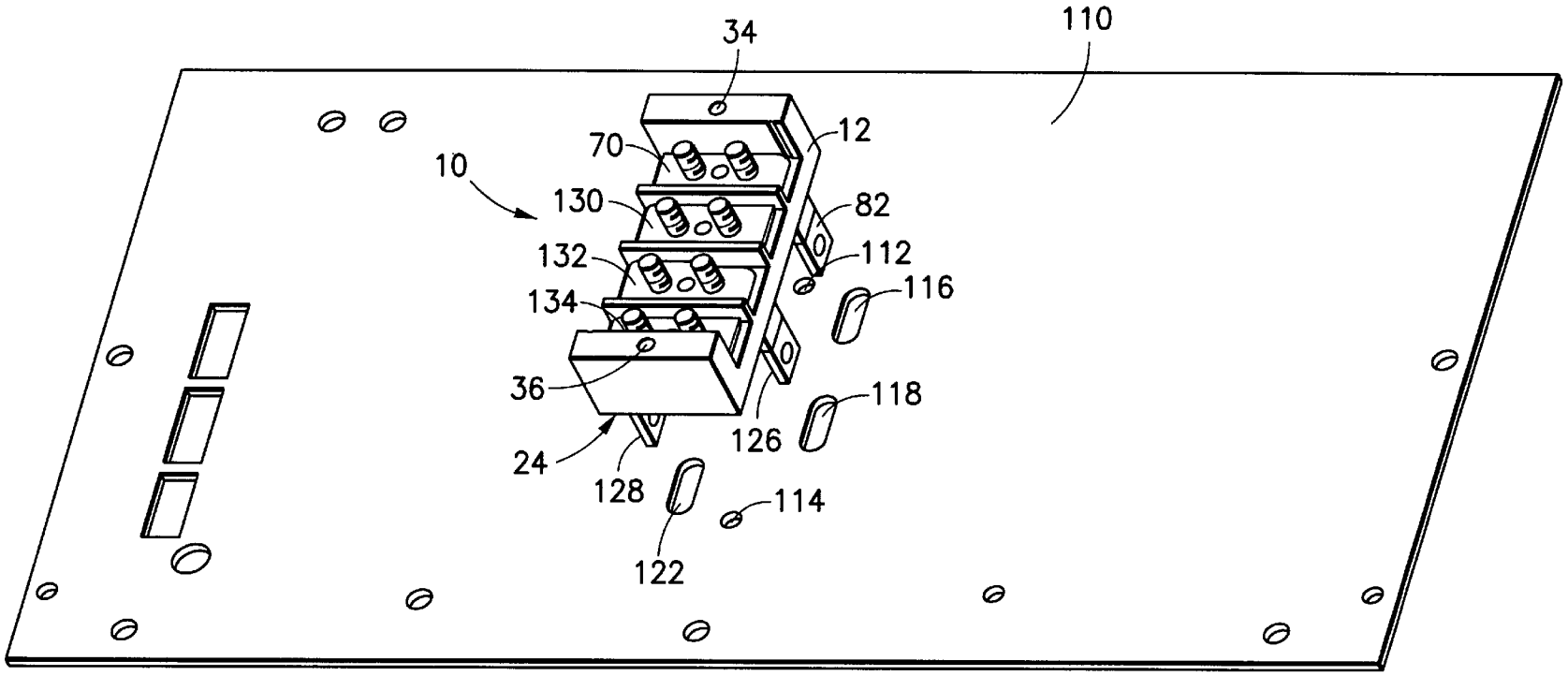
FIG. 5 is an exploded view of the assembly of a power block according to the first embodiment of the invention.
Figure 6:
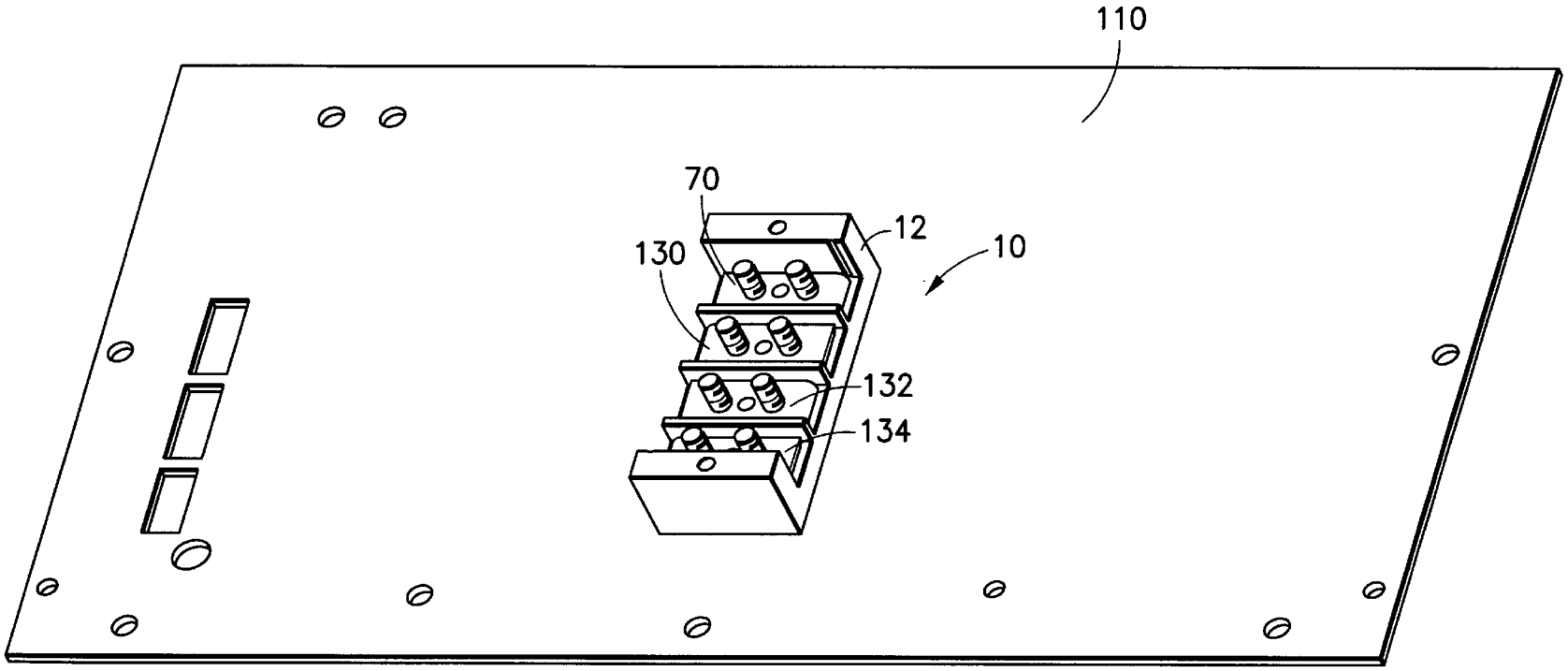
FIG. 6 is a perspective view of a power block assembly according to the first embodiment of the invention.
Figure 7:
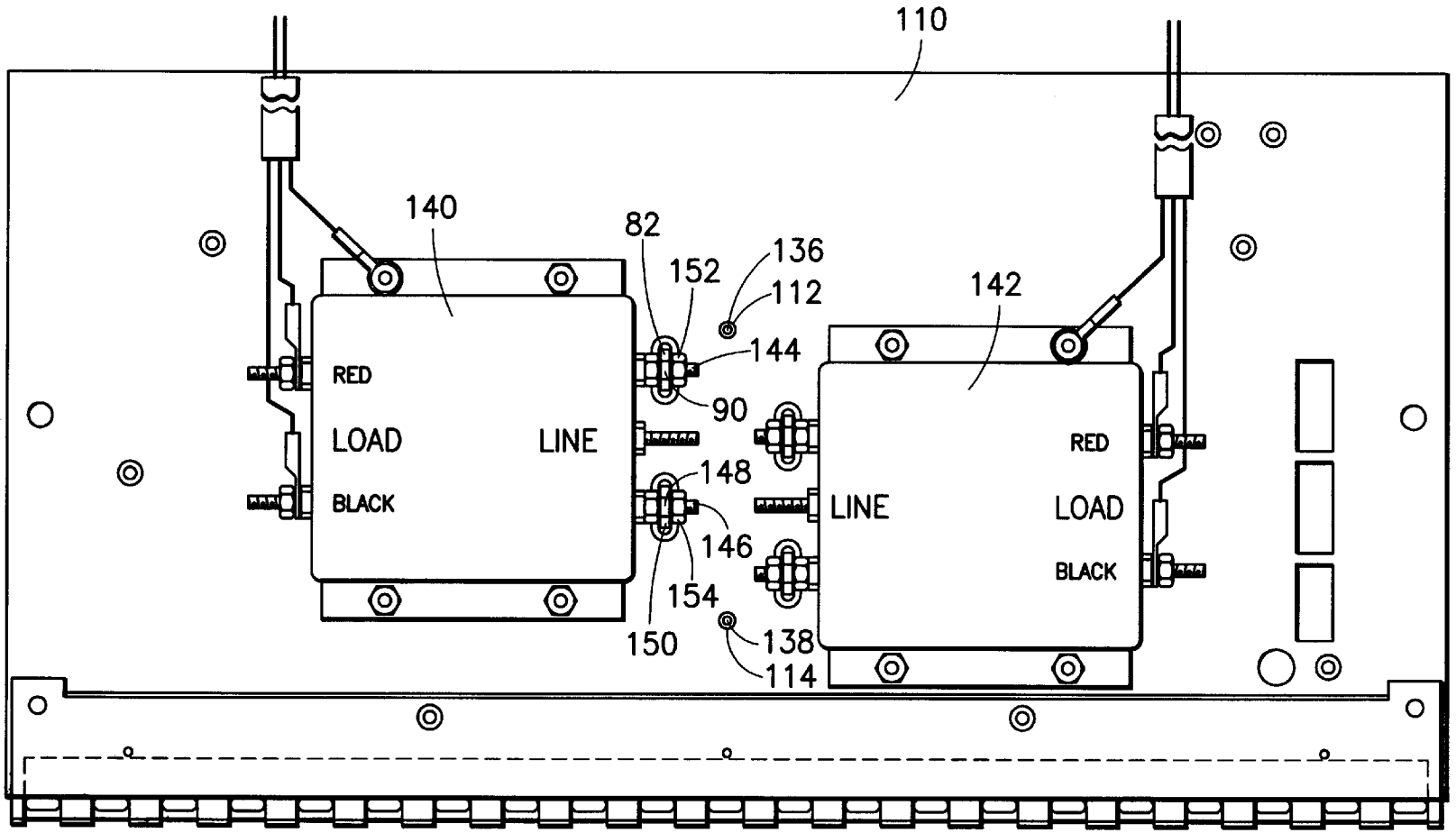
FIG. 7 is a top view of the rear of a panel upon which a power block according to the first embodiment of the invention is installed.

Turning to FIGS. 5 through 7, the assembly of the power block 10 to a panel 110 is shown. The panel 110 includes mounting holes 112, 114 and four receiving slots 116, 118, (120,) 122. Second portions 82, (124,) 126, 128 of conductors 70, 130, 132, 134 extend through the receiving slots such that the rear face 24 of the insulative block 12 is flush with the panel 110. The power block 10 is secured to the panel 110 with mounting screws 136, 138 (shown in FIG. 7) extending through the mounting bores 34, 36 and mounting holes 112, 114. Referring to FIG. 7, the opposite side of the panel 110 is shown. First and second power filters 140, 142 are mounted to the panel. The first power filter 140 has two threaded leads 144, 146 which are coupled to two of the conductors 82, 126 of the connection mounts which extend through the panel 110. Referring to FIGS. 6 and 7, threaded lead 144 extends through the lead hole 90 in the second portion 82 of the conductor 70 and the threaded lead 146 extends through a lead hole 148 in a second portion 150 of the conductor 132. Nuts 152, 154 are secured over threaded leads 144, 146. The leads of the second power filter 146 are likewise coupled to conductors of the power block 10.

It will be appreciated the design of the power block negates the need for intermediary wires, as the power block can be directly coupled to the power filters or other destination points (described below). As such, the voltage drop performance is improved and EMI immunity is increased. In addition, the braided conductors have high current capabilities, substantially improved over the intermediate wires of the prior art designs. Furthermore, the two stud design can easily accept two hole anti-rotation lugs or standard single hole lugs attached to the wires of a power source. Moreover, on-site installation and servicing is expedited with the improved design.

Figure 8:
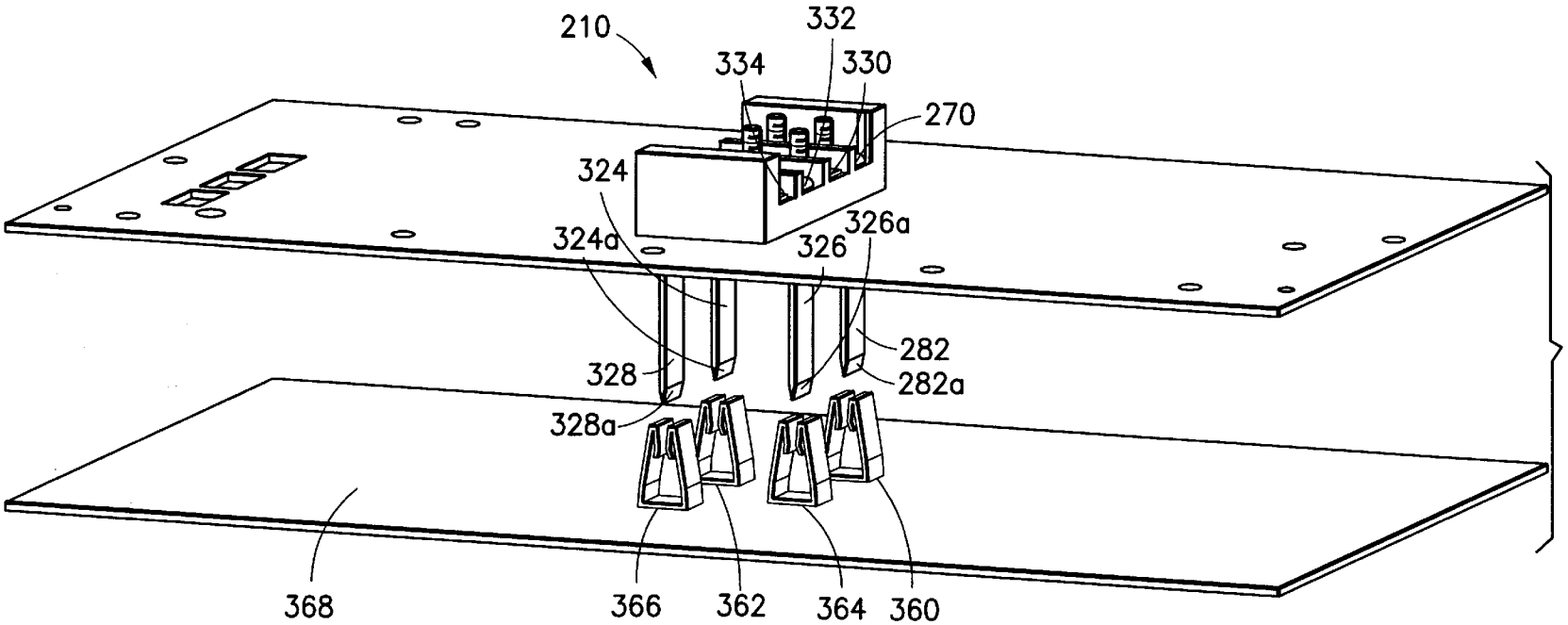
FIG. 8 is an exploded view of a power block according to a second embodiment of the invention.
Figure 9:
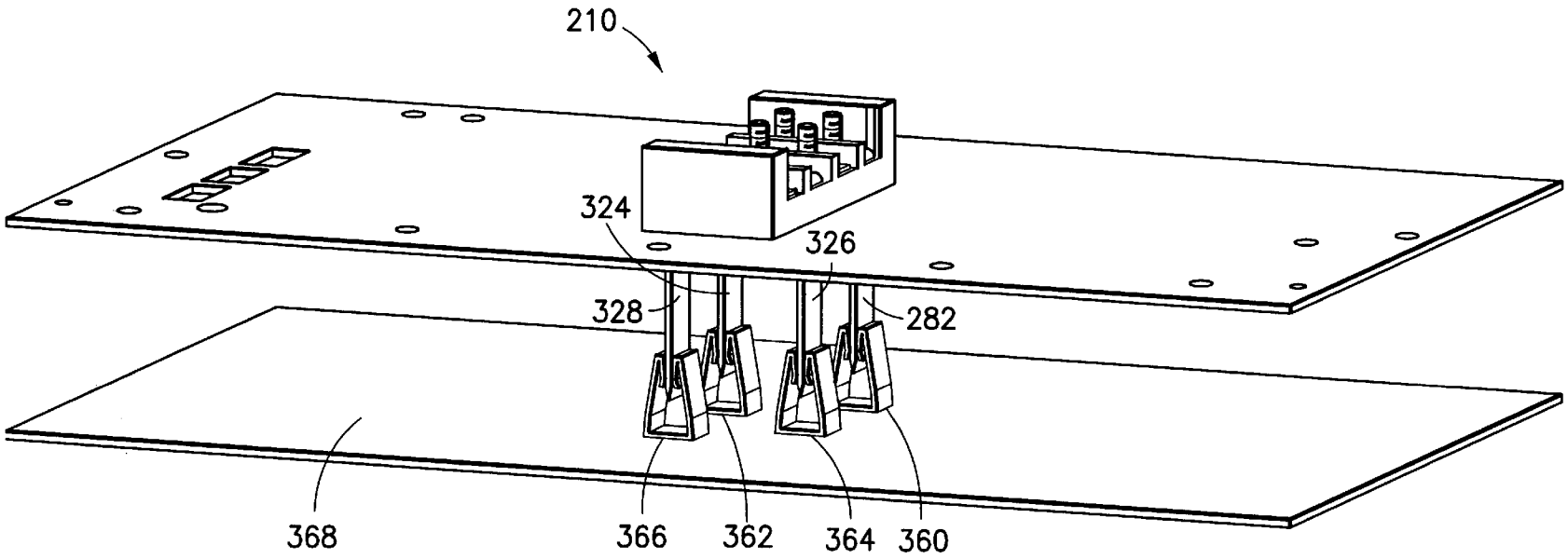
FIG. 9 is a perspective view of a power block according to a second embodiment of the invention.

Referring to FIGS. 8 and 9, a second embodiment of a power block 210, substantially similar to the first embodiment (with like parts having numbers incremented by 200), is shown. The conductors 270, 330, 332, 334 have second portions 282, 324, 326, 328 which are substantially longer and more rigid than the second portions described with respect to the first embodiment. The second portions have tapered free ends 282*a*, 324*a*, 326*a*, 328*a*. The tapered free ends are engageable by resilient clips 360, 362, 364, 366 located on a back plane 368. In this manner the power block can be easily "plugged" (FIG. 9) into the clips on the back plane and, likewise, can be easily removed from the back plane by "unplugging" the conductors from the clips.

Figure 10:
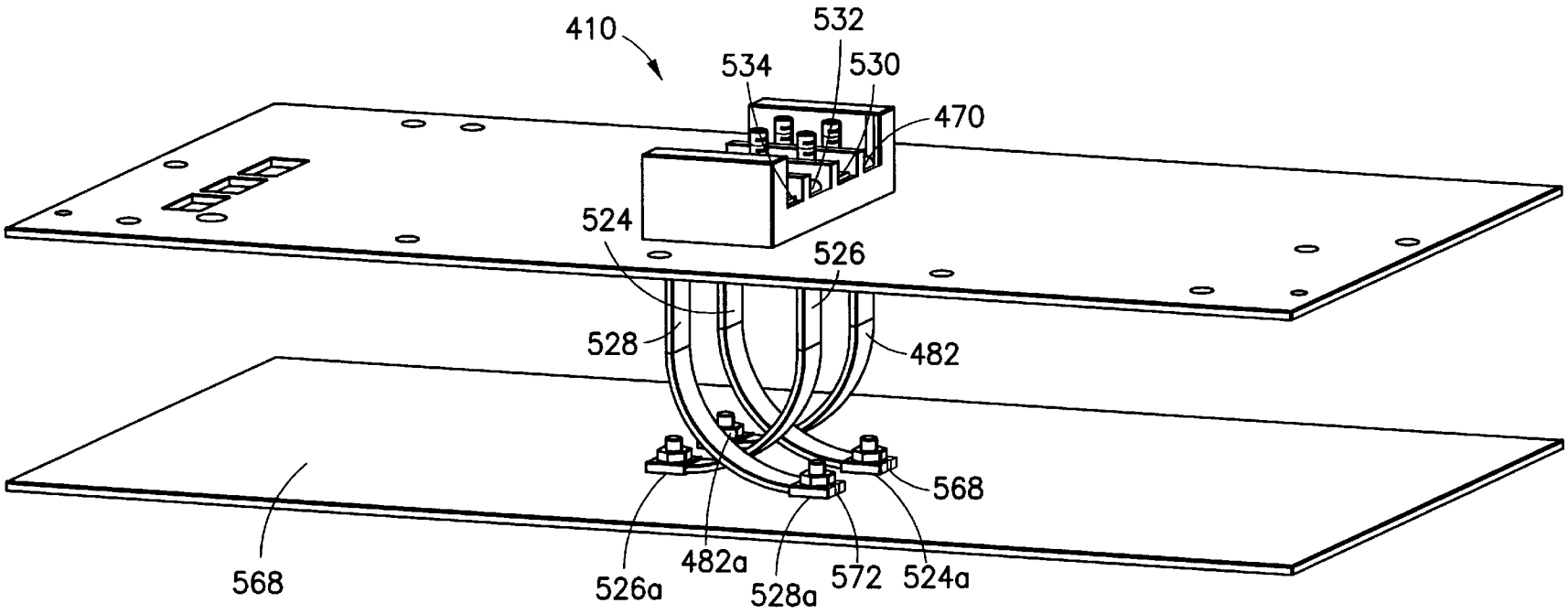
FIG. 10 is a perspective view according to a third embodiment of the invention.

Turning to FIG. 10, a third embodiment of a power block 410, substantially similar to the first embodiment (with like parts having numbers incremented by 400), is shown. The second portions 482, 524, 526, 528 of the conductors 470, 530, 532, 534 are substantially longer than the second portions described with respect to the first embodiment and are preferably more flexible. The second portions 482, 524, 526, 528 are provided with free ends 482*a*, 524*a*, 526*a*, 528*a* which are covered in preferably U-shaped sleeves defining slots (490,) 568, (570,) 572 or sleeves having coupling holes (shown in the first embodiment). The conductors are secured to the bus bar or back plane with studs and bolts. In this manner the power block can be secured to a bus bar or back plane 568 without any intermediary wires.

There have been described and illustrated herein several embodiments of a power block and a method of installing a power block. While particular embodiments of the invention have been described, it is not intended that the invention be limited thereto, as it is intended that the invention be as broad in scope as the art will allow and that the specification be read likewise. Thus, while particular materials for the insulative block, the conductors, and studs have been disclosed, it will be appreciated that other materials can be used as well. In addition, while particular dimensions and relative dimensions have been disclosed, it will be understood that such dimensions are only exemplary and that other dimensions and relative dimensions can be used. Furthermore, while the power block has been illustrated and described with four connection mounts, it will be appreciated that other configurations can be used as well. Moreover, while each connection mount has been shown to include two terminal studs, it will be appreciated that fewer or more terminal studs can be provided at each connection mount. In addition, raised end walls are not required. Furthermore, while the insulative block has been shown to be longitudinally symmetrical; i.e., having two opposing lateral slots in each channel, it will be appreciated that each channel may be provided with only a single lateral slot and that each adjacent channel may be provided with its lateral slot on a side opposite that of the adjacent channel of the insulative block. It will therefore be appreciated by those skilled in the art that yet other modifications could be made to the provided invention without deviating from its spirit and scope as so claimed.

We claim:

1. A panel feedthrough terminal block assembly for making an electrical connection between a first element separate from and positioned to a front side of said terminal block assembly and a second element separate from and positioned to a rear side of said terminal block assembly, said terminal block assembly, comprising:

a) an insulative block having front and rear faces;

b) at least one first conductor extending substantially outward from said front face and making a electrical connection to the first element; and c) at least one second conductor extending substantially outward from said rear face and non-axial with said at least one first conductor and making an electrical connection to the second element, wherein said at least one second conductor is conductively coupled to at least one of said at least one first conductor, and each of said at least one second conductor includes a first portion and a second portion oriented substantially orthogonal to said first portion, said first portion lying substantially along said front face and being coupled to one of said at least one first conductor and said second portion having a free end extending through said insulative block and beyond said rear face.

2. A power block according to claim 1, wherein:

said free end is provided with either a hole, a slot, or a taper.

3. A panel feedthrough terminal block assembly according to claim 1, wherein:

said second portion is substantially inflexible.

4. A panel feedthrough terminal block assembly according to claim 1, wherein:

said second conductor is made of a copper braid.

5. A panel feedthrough terminal block assembly according to claim 4, wherein:

said second conductor includes at least one copper sleeve over a portion of said copper braid.

6. A panel feedthrough terminal block assembly according to claim 1, wherein:

said insulative block is provided with a plurality of slots extending from said front face to said rear face through which said second portion of each of said at least one second conductor is extendible.

7. A panel feedthrough terminal block assembly according to claim 6, wherein:

said power block includes exactly eight first conductors and exactly four second conductors, wherein each of said second conductors is coupled to exactly two of said first conductors, and said power block includes exactly eight of said slots, aligned in two rows having four of said slots apiece, said second portions of each said second conductors extending through two of said four slots in each said row.

8. A panel feedthrough terminal block assembly according to claim 1, wherein:

each of said at least one first conductor includes a head, and said front face of said insulative block is provided with at least one depression into which said head of said at least one first conductor is countersunk.

9. A panel feedthrough terminal block assembly according to claim 1, further comprising:

d) at least one threaded coupling stud, wherein said insulative block is provided with at least one central bore, said at least one second conductor is provided with a coupling hole, and each said at least one coupling stud extends through one of said at least one coupling holes in said second conductor and through one of said at least one central bores.

10. A panel feedthrough terminal block assembly according to claim 1, wherein:

said power block includes exactly eight first conductors and exactly four second conductors, wherein each second conductor is coupled to exactly two first conductors.

11. A panel feedthrough terminal block assembly according to claim 1, wherein:

said power block includes at least two first conductors and said insulative block includes insulative dividers between each of said at least two first conductors.

12. A panel feedthrough terminal block assembly according to claim 1, wherein:

said insulative block includes two end walls which extend from the front face higher than said at least one first conductor.

* * * * *